US005624075A

United States Patent [19]

Dankert

[11] Patent Number: 5,624,075

[45] Date of Patent: Apr. 29, 1997

[54] SPRAY APPARATUS ATTACHMENT DEVICE

[75] Inventor: Manfred Dankert, Rodermark, Germany

[73] Assignee: ITW Oberflachentechnik GmbH, Dietzenbach, Germany

[21] Appl. No.: 438,009

[22] Filed: May 9, 1995

[30] Foreign Application Priority Data

May 9, 1994 [DE] Germany ..... 44 16 311.8

[51] Int. Cl.[6] ..... B05B 5/00

[52] U.S. Cl. ..... 239/690; 239/600; 285/29

[58] Field of Search ..... 239/600, 690, 239/166, 280; 901/43; 285/26, 29, 306

[56] References Cited

U.S. PATENT DOCUMENTS

| | | | |
|---|---|---|---|
| 4,064,656 | 12/1977 | Zeidler | 239/166 |
| 4,196,465 | 4/1980 | Buschor | 361/228 |
| 4,275,838 | 6/1981 | Fangmeyer | 239/223 |
| 4,319,772 | 3/1982 | Weirich et al. | 285/26 |
| 4,543,995 | 10/1985 | Weh et al. | 285/306 |
| 4,779,804 | 10/1988 | Baba et al. | 901/43 |
| 4,784,324 | 11/1988 | DeWitt | 239/166 |
| 5,092,364 | 3/1992 | Mullins | 285/29 |
| 5,249,830 | 10/1993 | Calmettes et al. | 285/29 |

FOREIGN PATENT DOCUMENTS

| | | | |
|---|---|---|---|
| 2446022 | 9/1974 | Germany . | |
| 966385 | 10/1982 | U.S.S.R. | 285/306 |

*Primary Examiner*—Andres Kashnikow
*Assistant Examiner*—Lisa Ann Douglas
*Attorney, Agent, or Firm*—Schwartz & Weinrieb

[57] ABSTRACT

A fixing device for a spraying device for fixing a spraying device (2) to a support (6), especially to an arm of a robot is disclosed. A mechanical quick-fixing device (16, 18, 20, 22, 26) and a pneumatic tensioning device (10, 12, 14) are provided in combination in such a way that the spraying device (2) may be quickly fixed mechanically to the support (6) or removed from it by the quick-fixing device, and that the spraying device (2), as long as it is mechanically fixed to the support (6), is pneumatically tensioned or biased relative to the support (6) by the pneumatic tensioning device.

15 Claims, 3 Drawing Sheets

SPRAY APPARATUS ATTACHMENT DEVICE

FIELD OF THE INVENTION

The invention relates to a spray apparatus attachment device for attaching a spray apparatus or implement to a carrier, particularly to the arm of a robot.

BACKGROUND OF THE INVENTION

Spray apparatus or implements are generally equipped with electrodes, which are connected to a high-voltage source and generate an electrostatic field to electrostatically charge the coating material. The spray apparatus of the invention can also be provided with such high-voltage electrodes. The coating material can be a liquid or a powder. Liquid coating material, for example, serves to coat car bodies. Powdered coating material can also be used to coat car bodies, but is currently used predominantly to coat other objects or structures, for example wall and ceiling elements, housings of household appliances, and the like. Spray apparatus of this type are generally referred to as "guns." They can have the form of hand-held guns or the form of spray devices which are attached to a carrier. By means of the carrier, they can preferably be moved in different directions relative to the objects to be coated. The carrier can be the arm of a robot, for example. To achieve good coating qualities, it is necessary that the spray apparatus not be able to wiggle in its movement.

From DE-AS 24 46 022, spray apparatus for electrostatically coating objects with liquid or powdered coating material is known. It contains a needle valve arranged axially with respect to the spray direction, which acts together with a valve seat directly upstream from a spray opening, by means of which seat, liquid coating material can flow to the spray opening. The spray apparatus has horn-like projections on diametrically opposite sides of the sprayed coating material downstream from the spray opening. In these horn-like projections, high-voltage electrodes are housed in air outlet channels, from which air flows outwardly so as to shape the atomized coating material spray. U.S. Pat. No. 4,275,838 shows a spray apparatus which has a rotating bell instead of a spray opening to atomize liquid coating material. Furthermore, U.S. Pat. No. 4,196,465 shows an electrostatic spray apparatus for spray-coating objects with powdered coating material. This spray apparatus contains a high-voltage generator and electrodes for electrostatically charging the powder. The spray device can be optionally provided with a handle for manual operation, or be attached to a carrier, for example, a robot arm.

SUMMARY OF THE INVENTION

The invention is intended to accomplish the task of developing a spray apparatus for spray-coating objects in such a way that it can be quickly attached to or removed from a carrier, for example, a robot arm, without being able to wiggle when in the attached state. At the same time, the spray apparatus is supposed to be structured in such a way that a switch to different coating materials and replacement of worn elements can be performed quickly, without long interruptions in the coating operation being necessary.

The foregoing task is accomplished, according to the invention, by the structural system more fully set forth and described in the specification which follows hereinafter.

BRIEF DESCRIPTION OF THE DRAWINGS

Various other objects, features, and attendant advantages of the invention is described with reference to the drawings, on the basis of a preferred embodiment as an example, in which like reference characters designate like or corresponding parts throughout the several views, and wherein.

DETAILED DESCRIPTION OF THE PREFERRED EMBODIMENT

Figure 1:
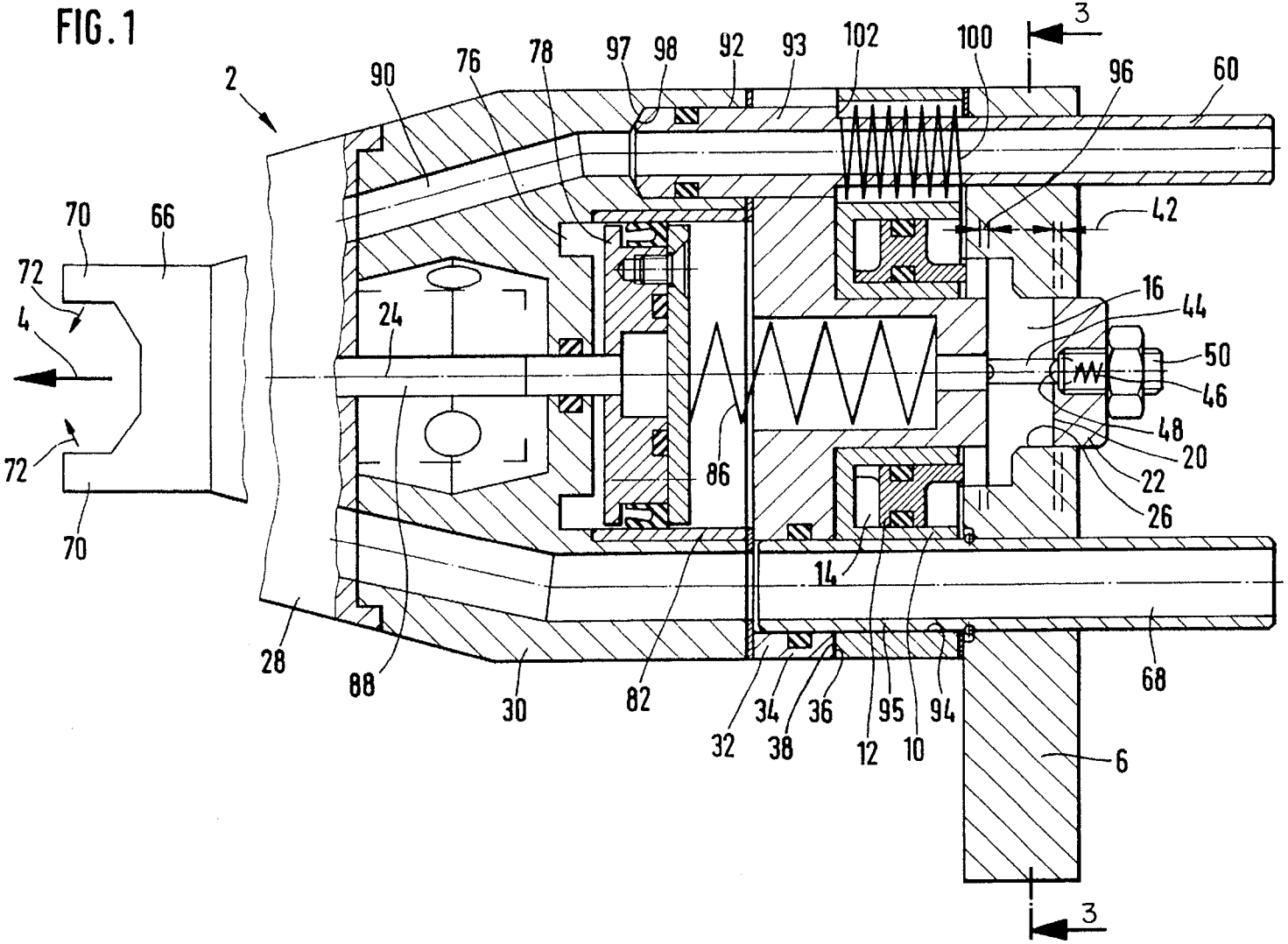
FIG. 1 is a longitudinal cross-section along the line I—I in FIG. 3 through a spray apparatus which is attached to a carrier, according to the invention, by means of a mechanical quick-connect device, but not yet pneumatically braced to the carrier.

The drawings show a spray apparatus 2 for spray-coating objects with coating material, which is sprayed in the direction of an arrow 4. This spray direction 4 corresponds to the longitudinal direction of the spray apparatus 2. The spray apparatus 2 shown in the drawings does not contain any electrical high-voltage electrodes for electrostatically charging the coating material. The spray apparatus 2 can, however, be equipped with such electrodes. In the example shown here, liquid coating material is used. The spray apparatus 2 is structured as a plug-in module which can be plugged into a carrier 6 and into the supply lines which are passed through the carrier 6, in order to attach the apparatus 2 and thereby connect the same to supply lines 60, 62, 64, 68, 74, 80.

On the side of the carrier 6 which faces toward the spray apparatus 2, a ring-shaped compressed air cylinder 10 is attached. The carrier 6 has the form of a plate and is a component of a spray-coating system, for example, the arm of a robot, which moves the spray apparatus 2, relative to an object to be coated, in a mode which is controlled by a computer. In the compressed air cylinder 10, a corresponding ring-shaped tension piston 12 can be braced against a coupling bolt 16, by means of compressed air in a compressed air chamber 14, counter to the spray direction. The coupling bolt 16 extends through a first coupling bore 18 formed in the carrier 6, and through a second coupling bore 20 which aligns with the first. The coupling bolt 16 projects out of the carrier 6, so that it can be operated by hand. The second coupling bore 20 extends radially through a coupling projection 22, which is disposed at the rear end of the spray apparatus 2, coaxially with respect to the center axis 24 of the spray apparatus 2, and is inserted into a coupling holder bore 26 of the connection plate 6, opposite the spray direction 4. The coupling holder bore 26 positions the spray apparatus 2 in the radial direction. The spray apparatus 2 has a front housing part 28, a central housing part 30, and a rear housing part 32, which are arranged axially one after the other. The rear housing part 32 consists, in one piece, of a flange part 34 and the smaller coupling projection 22, which extends axially away from the former. The flange part 34 lies against the frontal surface 38 of the compressed air cylinder 10 by means of its rearward flange surface 36 which surrounds the coupling projection 22 as an annular structure.

When the spray apparatus 2 is attached to the carrier 6, it is inserted into the coupling holder bore 26 by means of its coupling projection 22. Subsequently, the coupling bolt 16 is inserted through the first bore 18 of the carrier 6 and the second bore 20 in the coupling projection 22. The coupling holder bore 26, the coupling projection 22, the coupling bolt 16 and the bores 18 and 20 together form a mechanical quick-connect device for mechanical attachment of the spray apparatus 2 to the carrier 6.

However, it is not possible to guarantee a wiggle-free connection between the spray apparatus 2 and the carrier 6 solely by means of this mechanical quick-connect device. The tension piston 12 is therefore provided for wiggle-free bracing of these two parts relative to one another. The coupling bolt 16 has very little or no radial play in the second bore 20 of the coupling projection 22. However, the coupling bolt 16 has so much radial play 42 in the first bore 18 of the connection plate 6, in the longitudinal direction of the spray apparatus, on its rearward side, that the rearward flange surface 36 of the rear housing part 32 can be moved against the frontal surface 38 of the compressed air cylinder 10, which faces in the spray direction 4, and can be braced tight against it, if a suitable amount of air pressure is generated in the compressed air chamber 14, forcing the tension piston 12 from the unlocked position shown in FIG. 1, counter to the spray direction 4, to the locking and bracing position shown in FIG. 2. The compressed air cylinder 10 is open on its rearward side which faces the carrier 6. The compressed air chamber 14 is located on the frontal side disposed away from the carrier 6, between the cylinder 10 and the piston 12. When compressed air is supplied into chamber 14, the tension piston 12 presses on the coupling bolt 16, according to FIG. 2, causing the coupling bolt 16 to be braced backwards, together with the coupling projection 22 and the flange part 34, counter to the spray direction 4, such that the flange portion is tightly braced against the frontal surface 38 of the compressed air cylinder 10, coupling projection 22 is tightly braced within the carrier plate 6, and the coupling bolt 16 is tightly braced within the bore 18 of the carrier plate 6. This ensures that the spray apparatus 2 cannot wiggle relative to the carrier 6, and that the coupling bolt 16 cannot be pulled out of its bores 18 and 20. In order to prevent the coupling bolt from unintentionally falling out even if the compressed air is shut off, it can be provided with a ring groove 44, within which a ball 48, which is under stress from a spring 46 is spring biased when the coupling bolt 16 has reached its correct coupling position. The spring 46 and the ball 48 on which it acts are located in a setting screw 50, which is screwed into the coupling projection 22 on the rearward side. The compressed air cylinder 10 and the tension piston 12 thereby form a pneumatic bracing device.

For the operation of the spray apparatus 2, several supply lines are necessary. One of them is a material supply line 60. Furthermore, additional supply lines comprise a compressed air line 62 to supply compressed air to the compressed air chamber 14, an atomizer air line 64 to supply compressed air for atomization of the coating material at an atomizer nozzle 66 at the downstream end of the spray apparatus 2, and a third compressed air line 68 to supply compressed air which is directed onto the atomized coating material spray 4 in the form of air streams 72, by means of horn-like projections 70 on the atomizer nozzle 66, in order to give it a flattened spray shape. A fourth compressed air line 74 serves to supply compressed air to a second compressed air chamber 76 for activating a valve piston 78. Furthermore, a fifth compressed air line 80 is provided for supplying compressed air for surrounding high-voltage electrodes which can be provided for electrostatically charging the coating material, as well as an electrical line, not shown, for supplying electrical voltage. In the present embodiment, however, it is assumed that the spray apparatus 2 does not contain any high-voltage electrodes, and therefore no electrical line is shown. The electrical line can be a high-voltage line for supplying high voltage for the high-voltage electrodes. In another embodiment, however, the spray apparatus 2 can contain its own high-voltage generator, in which case the electrical line can be a low-voltage line.

Figure 2:
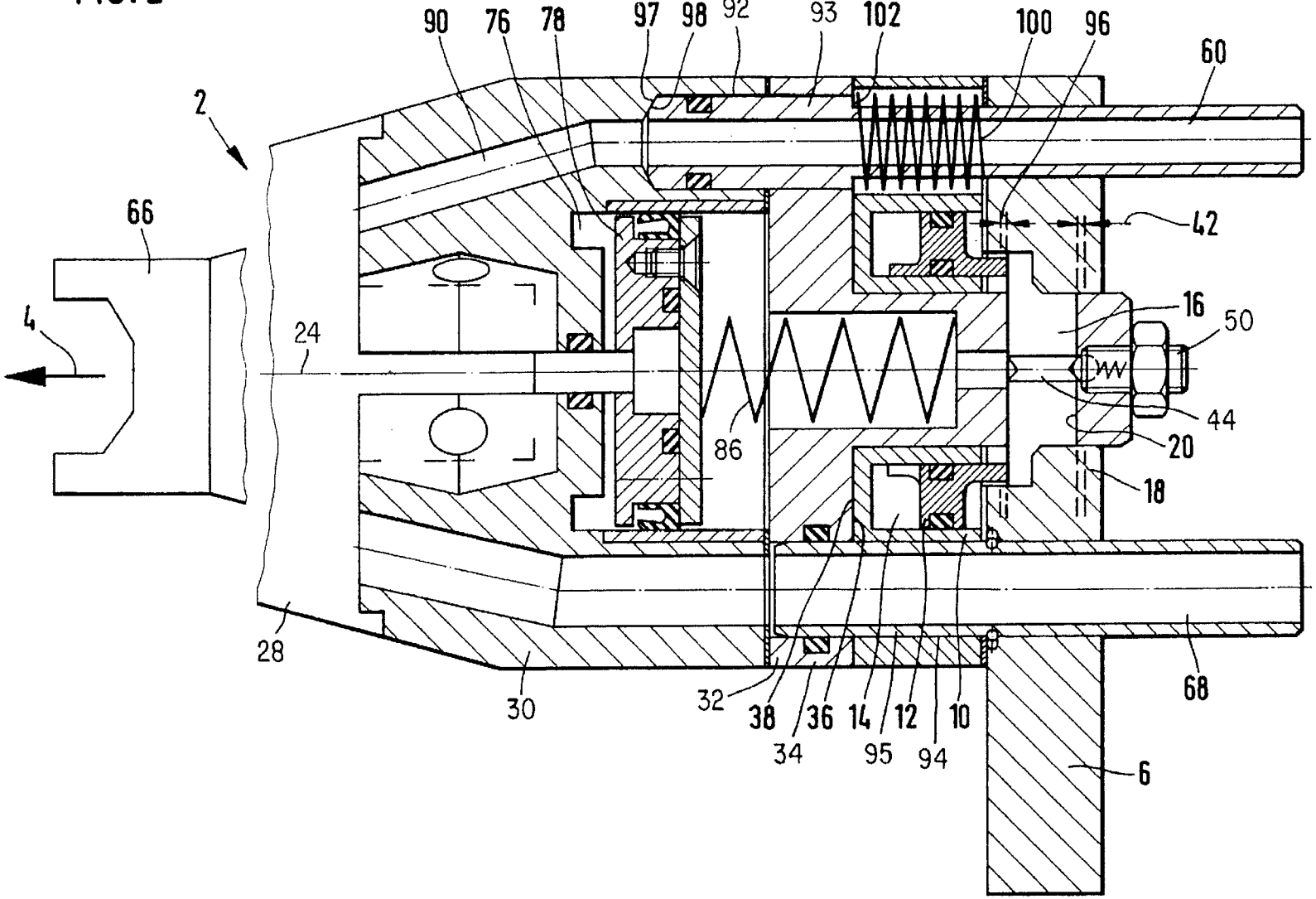
FIG. 2 is a view similar to that of FIG. 1 showing the spray apparatus of FIG. 1 in a longitudinal cross-section, after it has been pneumatically braced to the carrier, in addition to the mechanical attachment to the carrier, so as not to wiggle.
Figure 3:
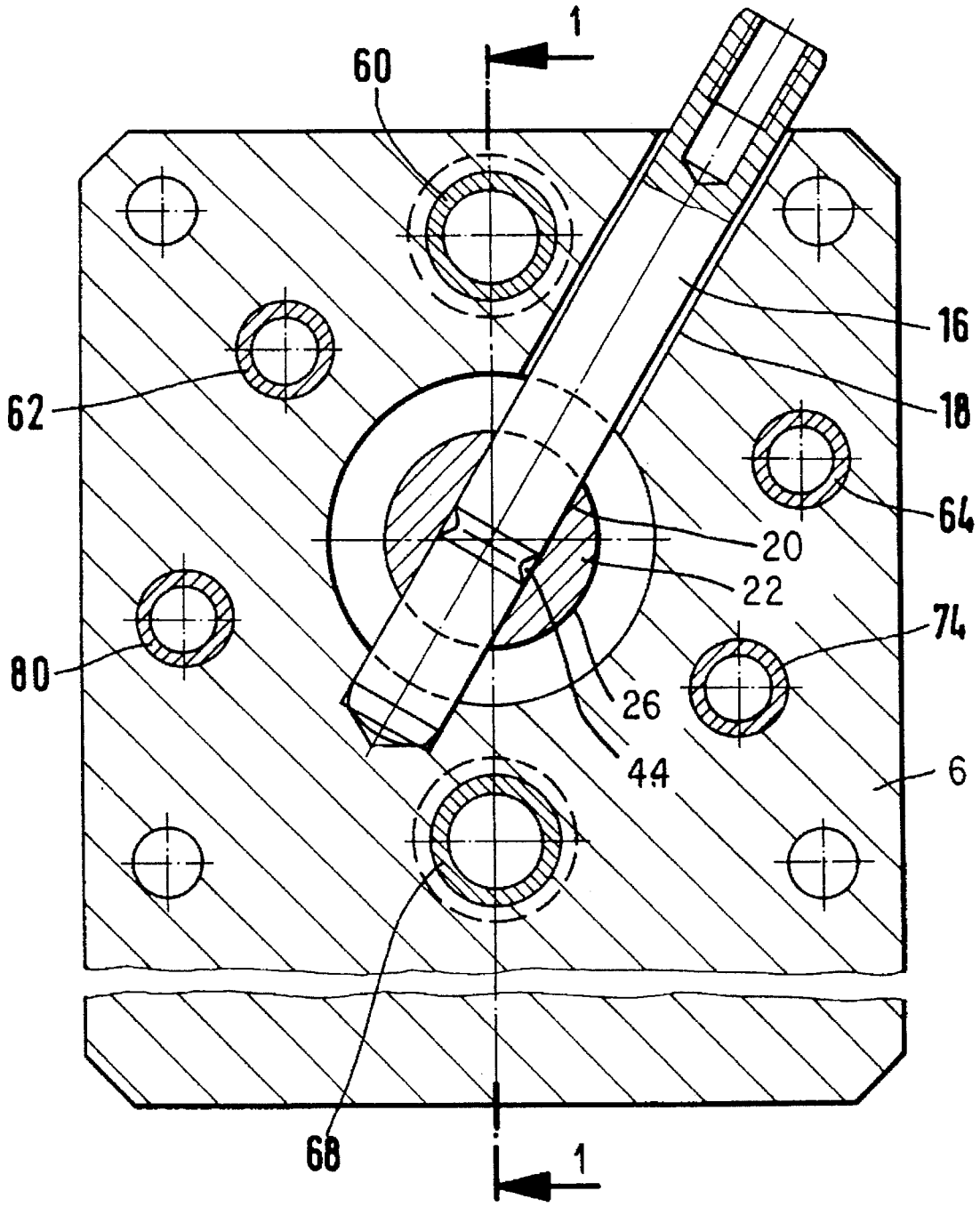
FIG. 3 is a cross-section along the plane line 3—3 of FIG. 1.

The valve activation piston 78 is disposed in the central housing part 30 within a second compressed air cylinder 82, which is coaxial with respect to the first compressed air cylinder 10, and can be moved from the valve-open position shown in FIG. 1 to a valve-closed position by means of compressed air in the second compressed air chamber 76, counter to an axially arranged pressure spring 86. When the compressed air of the second compressed air chamber 76 is shut off, the valve piston 78 is moved back to the valve-open position shown in FIG. 1 by the pressure spring 86. A valve element 88 is attached axially to the valve activation piston 78, which element 88 interacts with a valve seat, not shown, which is located in the flow path of a coating material channel 90.

All the supply lines 60, 62, 64, 68, 74, 80 of the spray apparatus 2 extend parallel to the longitudinal axis 24 of the spray apparatus through the carrier 6 and are inserted into corresponding channels of the spray apparatus 2.

The longitudinal axis 24 of the spray apparatus aligns with the spray direction 4 and is, at the same time, the center axis of the mechanical quick-connect device 16, 18, 20, 22, 26. This means that the spray apparatus 2 can be plugged into all the supply lines with a single plug-in movement in the longitudinal direction of the spray apparatus, and into the coupling holder bore 26. This means that the spray apparatus 2 can be quickly connected with the carrier 6 and all the supply lines, and quickly removed again. If the coating material is changed, the entire spray apparatus can be replaced with a clean one. It is no longer necessary to interrupt the coating operation in order to clean the spray apparatus on the carrier 6. Likewise, it can be simpler and faster to replace the spray apparatus 2 with another one when worn parts, such as the atomizer nozzle 66, are to be replaced, so that only very short interruptions in operation occur for the coating operation, while there is plenty of time to replace worn parts on the spray apparatus once it has been removed.

Corresponding to the supply lines 60, 62, 64, 68, 74 and 80, holder bores are formed in the spray apparatus 2, of which only a first holder bore 92 for the coating material line 60 and a second holder bore 94 for the third compressed air line 68 are shown in FIG. 1. These holder bores 92 and 94, an the others, not shown, form plug-in sockets into which the downstream line ends 93 and 95 of the supply lines 60 and 68, an the others, not shown can be plugged.

When the compressed air of the first compressed air chamber 14 for the tension piston 12 is shut off, for example at the end of a work day, the spray apparatus 2 continues to be held on the carrier 6 by means of the mechanical quick-connect device 16, 18, 20, 22, 26. Because of unavoidable movement or play between the individual elements, however, the spray apparatus 2 can wiggle relative to the carrier 6, and can move away from the carrier 6, for example by the movement or play 96 in FIG. 1, which is permitted in the carrier 6 between the front side of the coupling bolt 16 and the opposite front side of the first coupling bore 18. This causes a corresponding gap to be formed between the adjacent frontal surfaces 36 and 38 of the compressed air cylinder 10 and the flange part 34. This gap, which corresponds to the movement or play 96, also causes to be formed another gap between the downstream frontal surface 97 of the coating material line 60 and a ring-shaped channel shoulder 98 which lies opposite the latter, which gap is formed between the holder bore 92 and the coating material channel 90 and against which the frontal surface 97 of the line 60 rests, forming a seal, when the tension piston 12 braces the spray apparatus 2 against the carrier 6. So that no interstice between the frontal surface 97 at the line 60 can form at the downstream end of the coating material line 60 and the channel shoulder 98 when the compressed air of the first compressed air chamber 14 is shut off, a pressure spring 100 is placed between the carrier 6 and a shoulder 102 of the coating material line 60 which lies opposite it. This second pressure spring 100 pushes the coating material line 60 through the carrier 6 toward the front of the apparatus, into the holder bore 92, and thereby holds the frontal surface 97 of the coating material line 60 against the channel shoulder 98 of the coating material channel 90, even if the compressed air acting on the tension piston 12 has been shut off.

Obviously, many modifications and variations of the present invention are possible in light of the above teachings. It is therefore to be understood that within the scope of the appended claims, the present invention may be practiced otherwise than as specifically described herein.

I claim:

1. A system for fixedly mounting an implement upon a support carrier, comprising:

a support carrier having a first mounting surface defined thereon;

an implement to be mounted upon said support carrier and having a second mounting surface defined thereon for engaging said first mounting surface of said support carrier;

fastener means operatively connected to said implement and said support carrier for securing said implement upon said support carrier in such a manner that a predetermined amount of play, comprising a predetermined space defined between said first and second mounting surfaces of said support carrier and said implement, may exist between said first and second mounting surfaces of said support carrier and said implement; and means defined between said implement and said support carrier for moving said implement relative to said support carrier, when said implement is secured upon said support carrier by said fastener means, so as to tightly engage said first and second mounting surfaces of said support carrier and said implement and thereby eliminate said predetermined space and any play that may have existed between said first and second mounting surfaces of said support carrier and said implement despite said securing of said implement upon said support carrier by said fastener means.

2. The system as set forth in claim 1, wherein:

said support carrier comprises a support plate; and said implement comprises a spray-coating device for spraying coating material onto objects to be spray-coated.

3. The system as set forth in claim 2, wherein:

said support plate comprises a component of a computer-controlled robot arm.

4. The system as set forth in claim 2, wherein:

said support plate has a first coupling bore defined therethrough and along a longitudinal axis of said system;

said coating implement comprises a coupling projection coaxially disposed within said coupling bore of said support plate;

said support plate has a second coupling bore defined therein which has a longitudinal axis extending substantially perpendicular to said first coupling bore;

said coupling projection of said coating implement has a third coupling bore defined therein which is coaxially disposed with respect to said second coupling bore of said support plate; and said fastener means comprises a coupling bolt disposed within said second and third coupling bores of said support plate and said coupling projection for fixedly securing said coating implement upon said support plate.

5. The system as set forth in claim 4, further comprising:

an annular groove defined upon an outer peripheral surface of said coupling bolt; and a spring-biased ball element disposed within said coupling projection of said coating implement for seating within said annular groove of said coupling bolt in order to axially fix said coupling bolt within said third coupling bore of said coupling projection of said coating implement.

6. The system as set forth in claim 5, further comprising:

a spring member for spring-biasing said spring-biased ball element into said annular groove of said coupling bolt; and a set screw threadedly engaged within said coupling projection of said coating implement for housing said spring member and said spring-biased ball element.

7. The system as set forth in claim 6, wherein:

said means for moving said implement relative to said support carrier comprises fluidically actuated means.

8. The system as set forth in claim 7, wherein:

said fluidically actuated means comprises a compressed-air piston-cylinder assembly wherein said piston is actuated so as to laterally engage said coupling bolt fastener in a direction parallel to said longitudinal axis of said system and thereby brace said coupling bolt fastener within said second and third coupling bores of said support plate and said coupling projection of said coating implement so as to, in turn, tightly mount said coating implement upon said support plate.

9. The system as set forth in claim 8, wherein:

said piston and said cylinder of said piston-cylinder assembly annularly surround said coupling projection of said coating implement.

10. The system as set forth in claim 8, further comprising:

a plurality of through-bores, having axes disposed parallel to said longitudinal axis of said system, defined within said support plate; and a plurality of fluid material supply lines, for supplying said coating material and said compressed air, disposed within and extending through said plurality of through-bores of said support plate.

11. The system as set forth in claim 10, further comprising:

a plurality of sockets, having axes disposed parallel to said longitudinal axis of said system, defined within said coating implement for receiving said plurality of fluid material supply lines which extend through said support plate, whereby said coating implement and said support plate together comprise a plug-in connector facilitating plug-in connection of said coupling projection of said coating implement within said first coupling bore of said support plate, and plug-in connection of said fluid material supply lines within said plurality of through-bores of said support plate and within said plurality of sockets of said coating implement.

12. The system as set forth in claim 11, further comprising:

spring means interposed between said support plate and at least one of said plurality of material supply lines for biasing said at least one of said plurality of material supply lines into sealed contact with a respective one of said plurality of sockets defined within said coating implement.

13. The system as set forth in claim 11, wherein:

said plurality of fluid material supply lines and said plurality of sockets are arranged within an annular array within said support plate and said coating implement so as to be disposed about said first coupling bore of said support plate and said coupling projection of said coating implement which are disposed coaxially along said longitudinal axis of said system.

14. The system as set forth in claim 10, further comprising:

nozzle means provided upon a forward portion of said coating implement; and compressed air outlet means defined within said nozzle means, and supplied with compressed air by one of said plurality of fluid material supply lines, for discharging compressed air out from said nozzle means in order to atomize said coating material.

15. The system as set forth in claim 10, further comprising:

valve means coaxially disposed within said coating implement for controlling the discharge of said coating material;

spring-biasing means operatively connected to said valve means for biasing said valve means to a valve-closed position; and piston-cylinder means operatively connected to said valve means, and supplied with compressed air by one of said plurality of fluid material supply lines, for moving said valve means to a valve-opened position against the biasing force of said spring-biasing means.

* * * * *